US007048491B2

(12) United States Patent
Windbergs

(10) Patent No.: US 7,048,491 B2
(45) Date of Patent: May 23, 2006

(54) CRANE HOIST APPARATUS

(76) Inventor: Werner J. Windbergs, P.O. Box 25, Rockvale, CO (US) 81244

( * ) Notice: Subject to any disclaimer, the term of this patent is extended or adjusted under 35 U.S.C. 154(b) by 408 days.

(21) Appl. No.: 10/065,245

(22) Filed: Sep. 27, 2002

(65) Prior Publication Data

US 2004/0060886 A1 Apr. 1, 2004

(51) Int. Cl.
*B60P 1/54* (2006.01)

(52) U.S. Cl. ..... 414/542; 212/312; 212/315

(58) Field of Classification Search ..... 414/542; 212/312

See application file for complete search history.

(56) References Cited

U.S. PATENT DOCUMENTS 4,267,778 A * 5/1981 Wilkie ..... 104/94

FOREIGN PATENT DOCUMENTS

SU 115921 * 4/1985 ..... 212/312

OTHER PUBLICATIONS

Wayne Engineering Corporation, Sales Brochure for Cargo Master, Sales Promotion, published prior to Sep. 27, 2002, in the United States.

* cited by examiner

*Primary Examiner*—Thomas J. Brahan
(74) *Attorney, Agent, or Firm*—Law Office of Dale B Halling

(57) ABSTRACT

A crane hoist apparatus and method of use for moving items within, into, out of, or adjacent to an interior of a containerized cargo enclosure causing minimal loss of interior enclosure volume from the crane. The crane includes a first frame with a plurality of beams each having a span, a width, and a depth, the first frame is supported by the enclosure, also a second frame having a beam with a span, a width, and a depth, that is slidably supported by the first frame in a transverse span orientation, with the second frame depth not extending below the first frame depth, the second frame moves in a direction parallel to the first frame span. A winch carriage is slidably supported by the second frame wherein the winch does not extend below the second frame depth, the winch moving in a direction parallel to the second frame span.

14 Claims, 7 Drawing Sheets

CRANE HOIST APPARATUS

TECHNICAL FIELD

The present invention generally relates to cranes for the purpose moving items and more particularly to special purpose cranes for operation within a containerized cargo enclosure to move items both within the enclosure and exterior to the enclosure. The present invention addresses this situation by having a crane that is adapted to be supported by the enclosure with the crane contained within the enclosure and causing a minimal loss of interior enclosure volume from the crane apparatus.

BACKGROUND OF INVENTION

Containerized cargo has become ever more popular in recent years as a very efficient means of shipping a multitude of items or goods. Standard size containerized cargo enclosures are utilized on special ships that hold a numerous of these types of containers in a stacked arrangement on special container ships. These containers are carried both within the hull or container hold of the container ship and above the deck of the container ship with the container being of substantially rigid construction to support one another in a stacked arrangement while protecting the items within the container. With the ever increasing importation and exportation of items between different countries, containerized cargo has become one of the more significant methods of shipping. Frequently, shipping companies give transportation cost discounts to items that are designed to fit within the containers, as a container simplifies the loading and unloading of ships, the containers are also adapted to substitute as a semi truck trailer and can fit on railcars, so the same container can ship by sea or overland by truck or rail.

Given that containerized cargo has proven its utility in the shipping industry, there have been ancillary uses of containerized cargo enclosures, such as for long-term storage and protection of items, temporary offices at field sites, and for creating a small work area for light industrial uses. A typical container is constructed of carbon steel with a box or rectangular stock for a framework, the container also has having a corrugated sheet metal walls and top, with a stronger frame component on the bottom portion that allows for lifting lugs or hooks to be placed, or fork lift tangs from forklifts to be inserted for moving the enclosure. As previously mentioned, the containerized cargo enclosures are also configured to be stackable upon one another and also the bottom portion is adapted to attach to either a and semi truck bed or a rail car bed. When the containerized cargo container is used in its primary purpose for the hauling of various items, there is usually a door at one end of the container that opens for the items to be manually loaded and unloaded from the container. Typically, large items are pushed into the container or loaded inside the container by the use of a forklift truck with the large items being removed from the container in the same manner. Thus, loading and unloading large items from a container is normally a fairly simple operation not consuming too much time. However, when the containers are loaded with many small items that are not necessarily light in weight, being within the 50 lb. to 1,000 lb. range, loading and unloading the container can become an inefficient operation due to the manual handling of these numerous items.

When using a container for numerous small items that may or may not be heavy, the situation is much the same as a conventional semi truck trailer, where it has been recognized that having a special purpose built-in crane hoist apparatus within the cargo container can be very beneficial and useful in reducing the amount of time it takes to load and unload numerous small items. U.S. Pat. No. 5,062,760 to Samaniego discloses one such material handling system that uses a series of perpendicularly oriented frames and a winch cable assembly. The winch is able to move to any location within the enclosed van or trailer and also can extend a certain distance from the rear of the trailer thus allowing various items of cargo to be transported from a location within the enclosed trailer to a location outside of the trailer. The material handling system is attached to the interior of the cargo compartment adjacent to the roof portion. A similar system to is disclosed in U.S. Pat. No. 5,338,147 to Kucharczyk et al. and U.S. Pat. No. 4,297,071 to Dunbar that attempt to reduce the amount of head room consumed by the crane apparatus as compared to Samaniego. Both Kucharczyk et al. and Dunbar recognize one of the problems in the art in using this type of crane is that the normal crane construction of what is called the trolley or bridge type of crane dictates that the frames are mounted one below the other with the resulting winch carriage being mounted below the lowest frame. The purpose for this traditional crane construction is to maximize the lifting load capability of the crane by keeping the load directions in a specific beam axis that have the most beam strength. Also, this type a crane in its usual mounting location, which would either be a warehouse or factory, typically has extra high ceilings that can allow for this type of crane construction, which consumes a fair amount of vertical space or headroom. When utilizing a crane hoist apparatus within a cargo container, however, this consumption of vertical space or headroom is a negative factor in mounting a specialized crane apparatus inside of a cargo container, and thus design modifications need to be made to the crane frames and winch to minimize the vertical distance or headroom consumed.

However, when a crane is designed to absolutely minimize the vertical distance consumed or headroom there are compromises of the cranes weightlifting capacity when the frame beams are loaded in the same horizontal plane that induces a torsional moment component into the beam loading, wherein any given beam has considerably less strength when placed in a torsional loading state as opposed to a straight vertical load state. Thus, to minimize the consumption of vertical space or headroom there has to be a number of considerations in the slidable engagements between the frames and the carriage winch, in addition to a more difficult task of calculating the much reduced load carrying capacity of a crane constructed in this manner. What is needed is a crane hoist apparatus that is specifically designed to permanently mount in a containerized cargo enclosure with the crane hoist apparatus completely contained within the enclosure and with a crane having the capacity to extend outside or to the exterior of the enclosure to move items both within the enclosure interior and to and from the exterior of the enclosure. Also, what is needed is a crane hoist apparatus that consumes no more vertical space or headroom than the frame itself including all the slidably engaging frames that form the bridge or trolley including the carriage winch assembly. This type of crane hoist apparatus would act to absolutely minimize the loss of interior volume in the containerized cargo enclosure due to the installation of the crane while providing at the same time the efficiency and convenience of being able to move a number of items within and to the exterior the enclosure in a speedy manner.

SUMMARY OF INVENTION

It is an object of the present invention to provide a new and useful crane hoist apparatus and method for use in moving items within an interior of a containerized cargo enclosure with the result of a minimal loss of interior enclosure volume from the crane.

It is another object of the present invention to have the crane hoist apparatus completely contained within the containerized cargo enclosure.

It is further object of the present invention to utilize a first frame and a second frame that are slidably engaged with each other wherein the first frame and the second frame have an approximately transverse orientation to each other allowing a winch carriage that is slidably supported by the second frame to reach selected locations within the interior of the containerized cargo enclosure to move items.

Still another object of the present invention to have the first frame that is adapted to attach to the interior of the containerized cargo container with a slidable support that allows the first frame to movably extend from between a first retracted position in an interior of the containerized cargo enclosure to a second extended position in which the first frame extends to an exterior of the containerized cargo enclosure allowing for the winch carriage to reach selected locations on the exterior of the containerized cargo enclosure to move items.

According to the present invention, then, a crane hoist apparatus and method for use is provided in moving items within, into, out of, and adjacent or exterior to an interior of a containerized cargo enclosure is disclosed with the result of a minimal loss of interior enclosure volume from the crane. Broadly, the present invention includes a first frame having a plurality of beams that each include a lengthwise span, a width, and a depth, with the first frame being adapted to be supported by the containerized cargo enclosure. Also included, is a second fame having a beam with a lengthwise span, a width, and a depth, with the second frame being slidably supported by the first frame in an approximately transverse span orientation such that the second frame depth does not extend below the first frame depth. The second frame is able to move in a direction parallel to the first frame span. In addition, a winch carriage is included that is slidably supported by the second frame such that the winch does not extend below the second frame depth, with the winch being able to move in a direction parallel to the second frame span.

These and other objects of the present invention will become more readily appreciated and understood from a consideration of the following detailed description of the exemplary embodiments of the present invention when taken together with the accompanying drawings, in which;

REFERENCE NUMBER IN DRAWINGS

Figure 1:
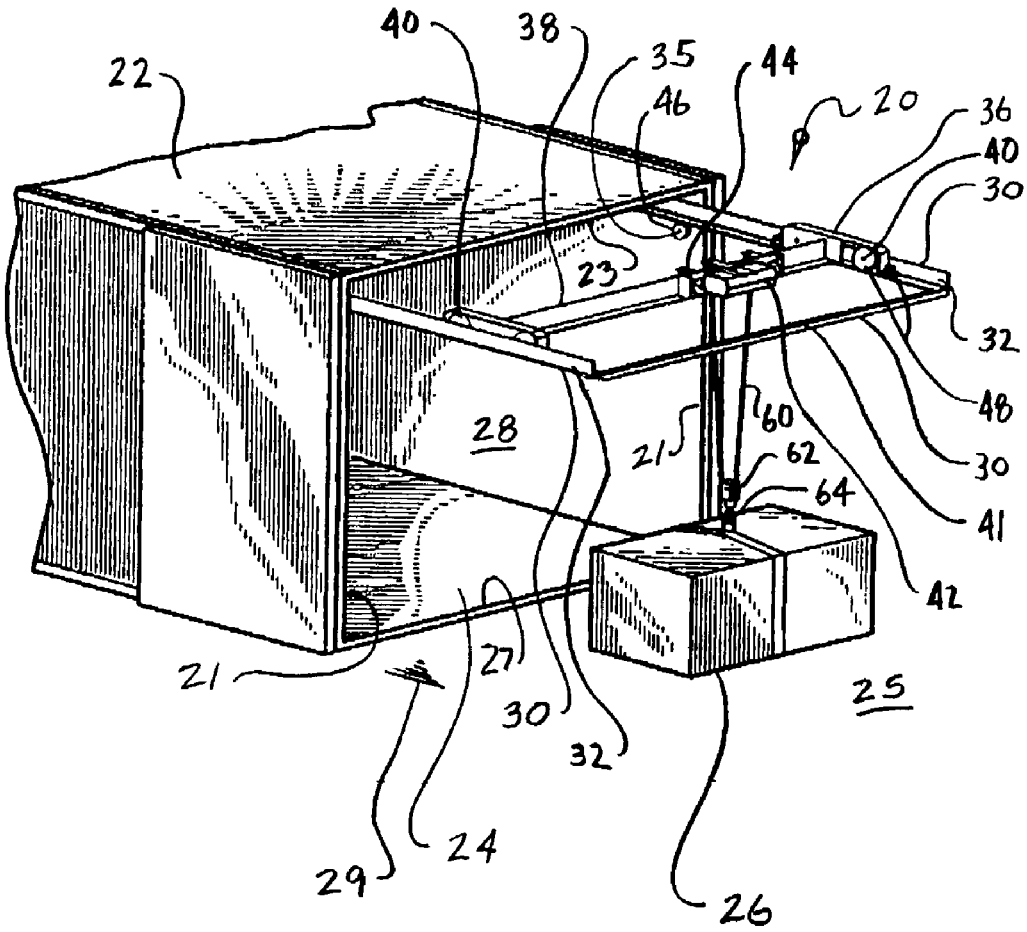
FIG. 1 shows a perspective view of the crane hoist apparatus assembly in use lifting the item adjacent to the containerized cargo enclosure, with the first frame in a second extended position to an exterior of the enclosure.

20 Crane Hoist Apparatus Assembly
21 Interior sidewall surface of enclosure
22 Containerized cargo enclosure
23 Interior roof surface of enclosure
24 Interior of containerized cargo enclosure
25 Exterior environment to the containerized cargo enclosure
26 Item moved or cargo
27 Floor surface of the enclosure
28 Interior enclosure volume
29 Surface adjacent to the enclosure
30 First frame
31 First frame beam width or horizontal extension
32 First frame beam
33 First frame beam depth or vertical extension
34 First frame support in containerized cargo enclosure
35 First frame slidable support
36 Second frame
37 Second frame beam width or horizontal extension
38 Second frame beam
39 Second frame beam depth or vertical extension
40 Second frame slidable support
41 First frame cross brace
42 Winch carriage
44 Winch carriage slidable support
46 First plurality of rollers
47 Second small roller
48 Second plurality of rollers
49 Second large roller
50 Third plurality of rollers
52 Third large roller
54 Third small roller
56 Hoist
58 Hoist support structure
60 Cable
61 Static cable attachment
62 Pulley block
64 Hook
66 Crane to container roof clearance
68 Vertical envelope or headroom consumed by crane
70 Vertical envelope or headroom consumed by second frame

DETAILED DESCRIPTION

Figure 2:
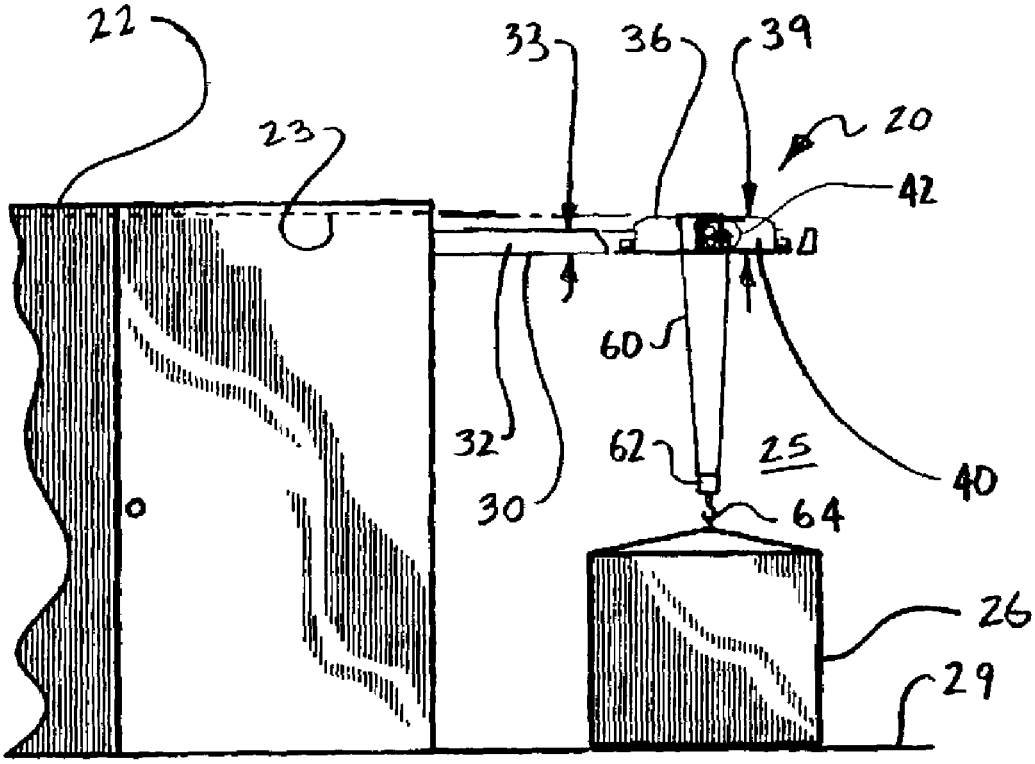
FIG. 2 shows a side elevation view of the crane hoist apparatus assembly in use lifting the item adjacent to the containerized cargo enclosure, with the first frame in the second extended position to the exterior of the enclosure.
Figure 3:
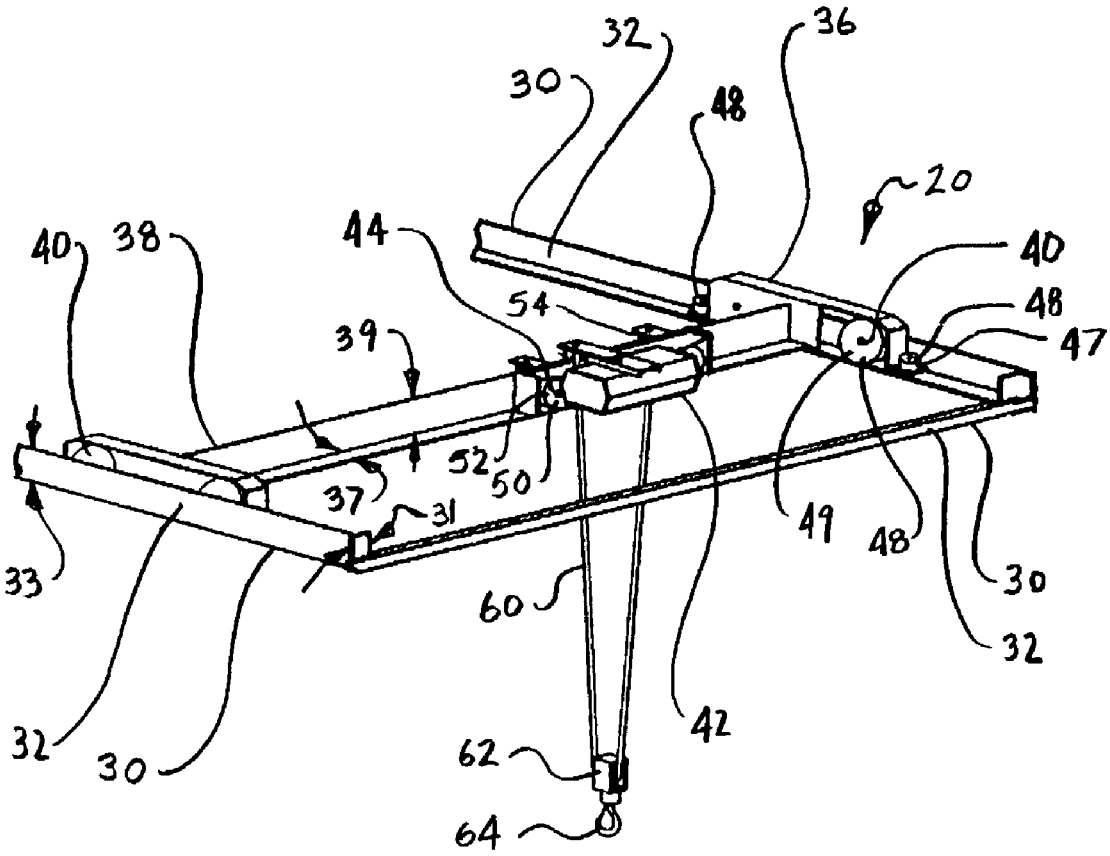
FIG. 3 shows a perspective view of the crane hoist apparatus assembly.

With initial reference to FIG. 1, FIG. 2, and FIG. 3 shown is a perspective view of the crane hoist apparatus assembly 20 in use lifting the item 26 adjacent to the containerized cargo enclosure 22, a side elevation view of the crane hoist apparatus assembly 20 in use lifting the item 26 adjacent to the containerized cargo enclosure 22, and a perspective view the crane hoist apparatus 20 respectively. FIGS. 1 and 2 show the first frame 30 in a second extended position to an exterior 25 to relative to the enclosure 22. Although the crane hoist apparatus assembly 20 shows the item 26 being lifted adjacent to the containerized cargo enclosure 22, the crane hoist apparatus assembly 20 is fully capable of retracting completely within the enclosure 22 to allow for placing the item 26 at a selected location within the interior volume 28 in the interior 24 of the enclosure 22. This ability of the first frame 30 to go to a first retracted position in the enclosure 22 by utilizing a slidable support 35 attachment to the interior 24 of the enclosure 22 allows the first frame beams 32 of the first frame 30 to movably extend parallel to the first frame beams 32. Thus the first frame 30 going between a first retracted position in which the first frame 30 is accommodated entirely within the interior volume 28 of the enclosure 22 to a second extended position of the first frame 30 extending to the exterior 25 of the enclosure 22 as shown.

The slidable support attachment 35 is preferably comprised of a first plurality of rollers 46 that act to support the first frame 30 being the first frame beams 32 in particular in the interior 24 of the enclosure 22. Alternatively, the slidable support attachment 35 could be a toothed sprocket with the teeth matingly engaging the first frame beams 32 to allow a rotating shaft to move the first frame 30 between the first retracted position and the second extended position. In addition, a hydraulic ram could be utilized to move the first frame 30 between the first retracted position and the second extended position. This allows the crane hoist apparatus 20 to be able to move the item 26 either entirely within the enclosure interior volume 28, or from the interior enclosure volume 28 to the exterior of the enclosure 25 or vice versa. In addition, the crane hoist apparatus 20 is able to move the item 26 adjacent to the enclosure 22 in an area defined by the second extended position of the first frame 30. Alternatively, the first frame 30 can also use utilize a fixed or non slidable support attachment to the interior 24 of the enclosure 22. This would result in the first frame 30 being in a fixed position within the enclosure 22 and not being able to achieve a second extended position as previously mentioned, this would result in restricting movement of the item 26 to within the enclosure interior 28 by the crane hoist apparatus 20.

The crane hoist apparatus 20 is attached to the enclosure 22 so as to be dedicated to that particular closure 22 for moving the item 26 or any applicable cargo as required and previously discussed. An advantage of the crane hoist apparatus 20 mounted in the interior 24 of the enclosure 22 is to minimize the loss of interior enclosure volume 28 that is consumed by the crane hoist apparatus assembly 20. The crane hoist apparatus 20 is designed to minimize the loss of headroom within the interior closure volume 28, this being accomplished by nesting the three major components of the crane hoist apparatus 20, being the first frame 30, the second frame 36, and the winch carriage 42 such that the three major aforementioned components all reside within the same vertical space envelope. This would be contrasted with a conventional crane hoist apparatus having the same 3 components, being a stationary first frame, with a second frame or bridge transversely positioned to be slidably engaged with the stationery first frame, and a conventional winch carriage or trolley that is slidably engaged with the bridge. In a conventional crane hoist apparatus these three components all drop down below each other vertically with the purpose being to maximize the lifting capability of the crane by utilizing higher load capacity I-beams that have balanced or straight down loads to avoid inducing any torsional moments into any of the aforementioned three conventional crane components. For the conventional crane, this is an acceptable arrangement as they are typically no vertical height or headroom restrictions, thus maximizing the conventional crane's lifting capabilities for the cost of materials involved is acceptable and desirable.

The present invention of a crane hoist apparatus 20 while achieving the goal of minimizing the amount of interior enclosure volume 28 consumed, forces a compromise on the crane hoist apparatus 20 lifting capability from having to use weaker beam configurations and the inducing of torsional moments into the three major components, being the first frame 30, second frame 36, and the winch carriage 42 which results in reduced crane hoist apparatus 20 lifting capacity. However, as the item moved 26 is limited to smaller cargo that is typically put into and removed from an enclosure 22, the crane hoist apparatus 20 lifting capacity of 1,000 lbs. is acceptable with the aforementioned compromises. Looking to FIGS. 1, 2, and 3, and more particularly to the crane hoist apparatus 20 itself, the first frame 30 has a plurality of beams or running rails 32 that each include a lengthwise span, a width or horizontal extension 31, and a depth or vertical extension 33. Also included is at least one first frame cross brace 41 to maintain the desired span between the beams 32 for the second frame 36.

The preferred materials of construction for the first frame beams 32 are angle iron or angle beams sized as a 4 inch vertical extension 33 by a 3 inch horizontal extension 31 by ¼ inch in thickness being constructed of typical structural steel. Alternatively, other beam 32 configurations would be acceptable such as I beams, channel beams, T beams, and the like also being constructed of structural steel or other materials and configurations that would be suitable for the aforementioned crane hoist apparatus 20 capacity. The first frame 30 is adapted to be supported by the closure 22 with either a slidable support or a fixed support as previously described. Preferably, the slidable support or a fixed support as previously described for the first frame beams 32 to the enclosure 22 utilizes the interior sidewalls 21 of the enclosure 22 for supporting the first frame beams 32. The second frame 36 has a second frame beam 38 with a lengthwise span, a width or horizontal extension 37, and a depth or vertical extension 39. The preferred materials of construction for the second frame beam 38 are angle iron or angle beam sized as a 5 inch vertical extension 39 by a 3 inch horizontal extension 37 by ¼ inch in thickness being constructed of typical structural steel. Alternatively, other beam 38 configurations would be acceptable such as I beams, channel beams, T beams, and the like constructed of structural steel or other materials and configurations that would be suitable for the aforementioned crane hoist apparatus 20 capacity.

The second frame or bridge 36 is slidably supported 40 by the first frame 30 and in particular the first frame beams 32 in an approximately transverse span orientation. The positional of relationship between the first frame 30 and the second frame 36 is such that the second frame depth 39 does not extend below the first frame depth 33, this allows for the minimal loss of vertical headroom within the enclosure interior volume 28. In other words, the first frame 30 and the second frame 36 generally occupy the same vertical space envelope within the enclosure interior 24. The dynamic relationship between the second frame 36 and the first frame 30 is such that the second frame 36 is able to move in a direction parallel to the first frame 30 span of the first frame beams 32. The slidable support 40 preferably comprises a second plurality of rollers 48 slidably supporting the second frame 36 on the first frame 30 or more particularly on the first frame beams 32. The second plurality of rollers 48 include a plurality of second large rollers 49 that have a rotational axis parallel to the first frame being width or horizontal extension 31 with the second large rollers 49 being in rolling engagement with the first frame horizontal extension 31. Also included in the second plurality of rollers 48 is a plurality of the second small rollers 47 that have a rotational axis parallel to the first frame and beam depth or vertical extension 33 with the second small rollers 47 being in rolling engagement with the first frame vertical extension 33.

A winch carriage or trolley 42 is slidably supported 44 by the second frame 36 such that the positional relationship between the winch carriage 42 and the second frame 36 results in the winch carriage 42 not extending below the second frame depth 39. Again, similar to the positional relationship between the first frame 30 and the second frame 36, the winch carriage 42 and the second frame 36 generally occupy the same vertical space envelope within the enclosure interior 24 to also minimize the loss of vertical headroom within the enclosure interior volume 28. The dynamic relationship between a winch carriage 42 and the second frame 36 is such that the winch carriage 42 is able to move in a direction parallel to the second frame 36 span. The slidable support 44 of the winch carriage 42 is comprised of a third plurality of rollers 50 for supporting the winch carriage 44 by the second frame 36 being more particularly the second frame beam 38. The third plurality of rollers 50 preferably includes a plurality of third large rollers 52 having a rotational axis parallel to the second frame beam width or horizontal extension 37 with the third large rollers 52 being in rolling engagement with the second frame horizontal extension 37. The third plurality of rollers 50 also includes a plurality of the third small rollers 54 having a rotational axis parallel to the second frame beam depth or vertical extension 39 with the third small rollers 54 that are in rolling engagement with the second frame beam vertical extension 39.

Figure 4:
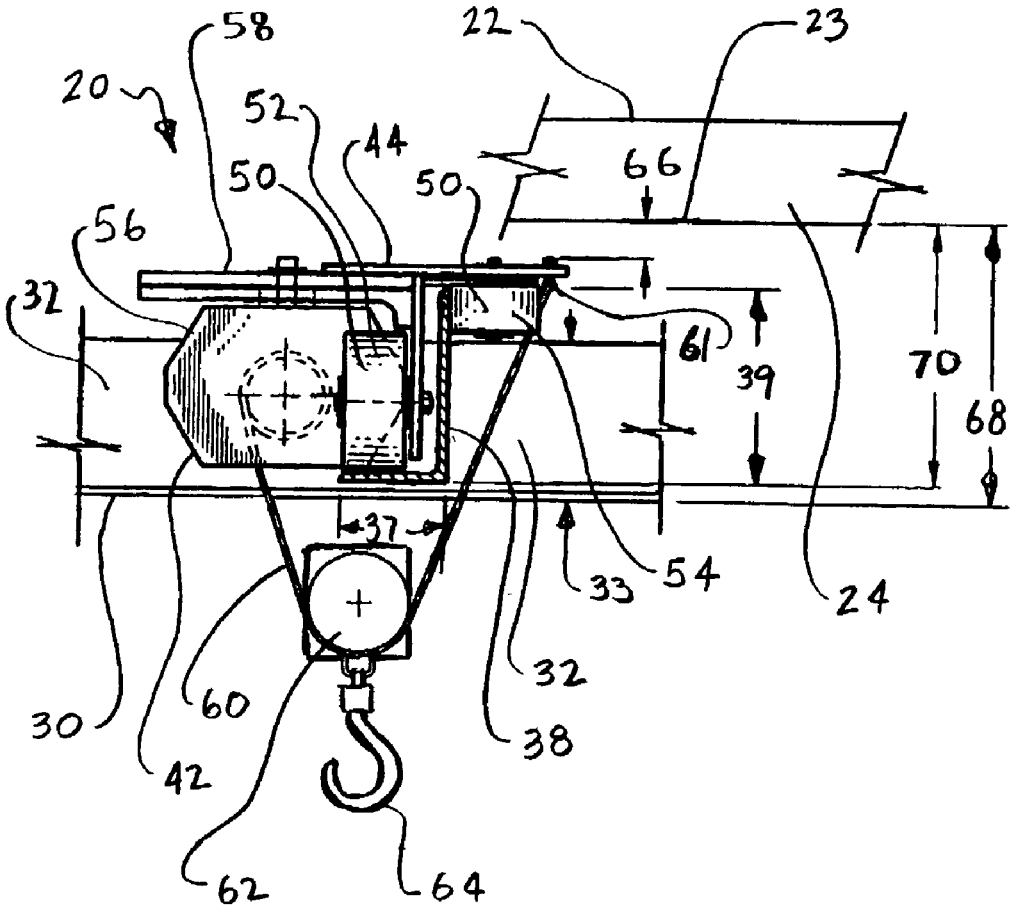
FIG. 4 shows a side elevation view of the winch carriage.

Further turning to FIG. 4 shown is a side elevation view of a portion of the crane hoist apparatus 20, including the winch carriage 42 that is slidably engaged on the second frame beam 38, with the first frame beam 32, and the container 22 shown in the background. In this particular view the second frame slidable support 40 and second frame 36 are removed from FIG. 4 for clarity to more clearly show the vertical nesting relationship between the winch carriage 42, the second frame beam 38, and the first frame 30 and first frame beam 32, and first frame beam depth 33 as positionally related to the enclosure 22. It can be seen that the winch carriage 42, the second frame beam 38 which includes the second frame 36, and the first frame 30 which includes the first frame beam 32 all occupy the same vertical space as defined by vertical envelope 68. The crane hoist apparatus 20 is positioned to be at a minimal distance below the interior roof surface 23 being defined as the crane to container roof clearance 66, which is typically ¼ of an inch. Vertical envelope 68 is a drop down vertical space or volume consumed within the enclosure interior 24 by the crane hoist apparatus 20. The actual vertical space consumption of the crane hoist apparatus 20 would be defined by the vertical envelope 68 which is typically 6⅞ inches less the crane to container roof clearance 66 which is typically ¼ inch resulting in a total crane hoist apparatus vertical space consumption of about 6⅝ inches. Thus, the 6⅝ inches would be the loss of interior volume for the enclosure interior 24. However, a more realistic loss of vertical headroom in the enclosure interior 24 would be defined by a vertical envelope or headroom consumed by the second frame distance 70, being typically 6¾ inches below the interior roof surface 23 as this is the actual loss of vertical headroom between the enclosure 22 sidewalls 21 with the exception of the two horizontal extensions of the first frame beam 31 projecting about 3 inches from each sidewall 21.

The winch carriage 42 includes a hoist 56, and a hoist or winch carriage cable 60, a pulley block 62 with a hook 64, with all of the aforementioned components being supported by a hoist support structure 58. The hoist 56 is preferably an electric drum type wherein the cable 60 is wound around the drum, the hoist 56 should have a lifting capacity of 1,000 lbs. Alternatively, the hoist 56 could be hydraulically or pneumatically powered while still having a lifting capacity of 1,000 lbs. As FIG. 4 shows, the vertical centerline of the pulley block 62 and hook 64 are preferably closely centered under the third large roller 52 by the positioning of the static cable attachment 61 on the hoist support structure 58, with the purpose of this to minimize the torsional moments induced into the second frame beam 38 from the hoist 56 lifting an item. The winch carriage or trolley 42 is slidably supported 44 by the second frame beam 38 such that the positional relationship between the winch carriage 42 and the second frame beam 38 results in the winch carriage 42 not extending below the second frame depth 39. Again, similar to the positional relationship between the first frame 30 and the second frame 36, the winch carriage 42 and the second frame 36 which includes the second frame beam 38 generally occupy the same vertical space envelope 68 within the enclosure interior 24 to also minimize the loss of vertical headroom within the enclosure interior volume 28.

The dynamic relationship between the winch carriage 42 and the second frame beam 38 is such that the winch carriage 42 is able to move in a direction parallel to the second frame beam 38 span. The slidable support 44 of the winch carriage 42 is comprised of a third plurality of rollers 50 for supporting the winch carriage 44 by the second frame 36 being more particularly the second frame beam 38. The third plurality of rollers 50 preferably includes a plurality of third large rollers 52 having a rotational axis parallel to the second frame beam width or horizontal extension 37 with the third large rollers 52 being in rolling engagement with the second frame horizontal extension 37. The third large rollers 52 are preferably constructed of a resilient material capable of the aforementioned crane hoist apparatus 20 loads, being about 6 inches in diameter and 2 inches wide, with other sizes acceptable that meet the minimizing of vertical headroom consumed by the crane hoist apparatus 20 and aforementioned load requirements. The third plurality of rollers 50 also includes a plurality of the third small rollers 54 having a rotational axis parallel to the second frame beam depth or vertical extension 39 with the third small rollers 54 that are in rolling engagement with the second frame beam vertical extension 39. The third small rollers 54 are preferably constructed of a resilient material capable of the aforementioned crane hoist apparatus 20 loads, being about 2½ inches in diameter and 1¼ inches wide, with other sizes acceptable that meet the minimizing of vertical headroom consumed by the crane hoist apparatus 20.

Figure 5:
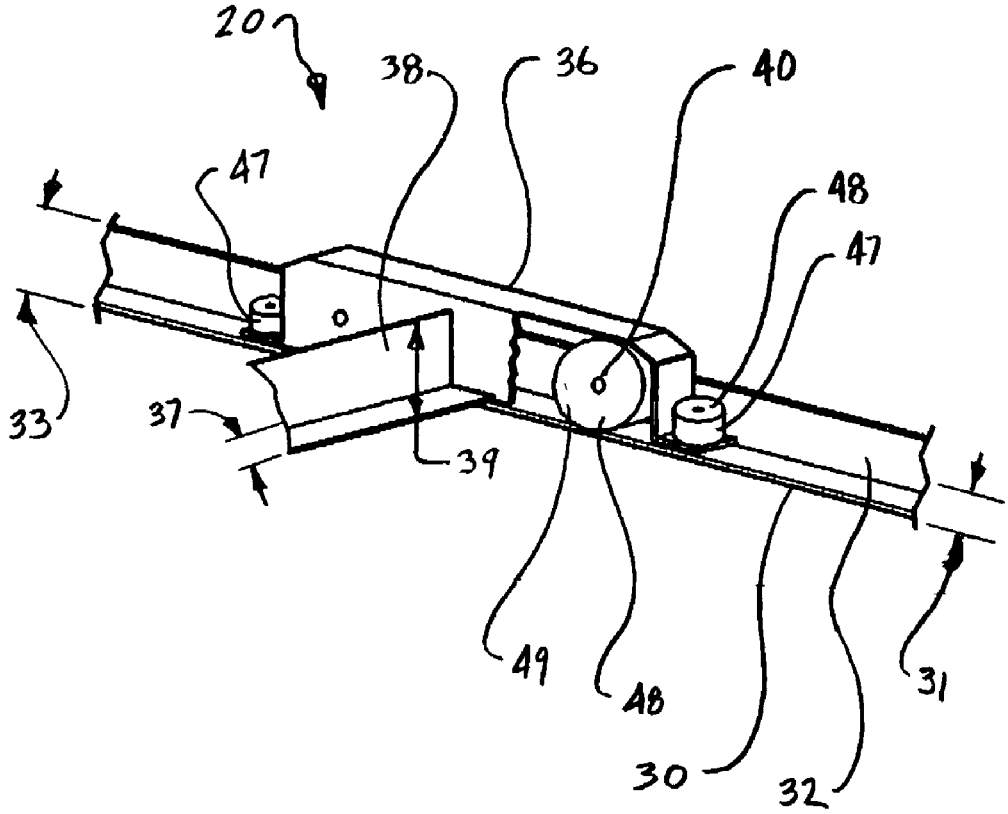
FIG. 5 shows a perspective view of the slidable support of the second frame by the first frame.
Figure 6:
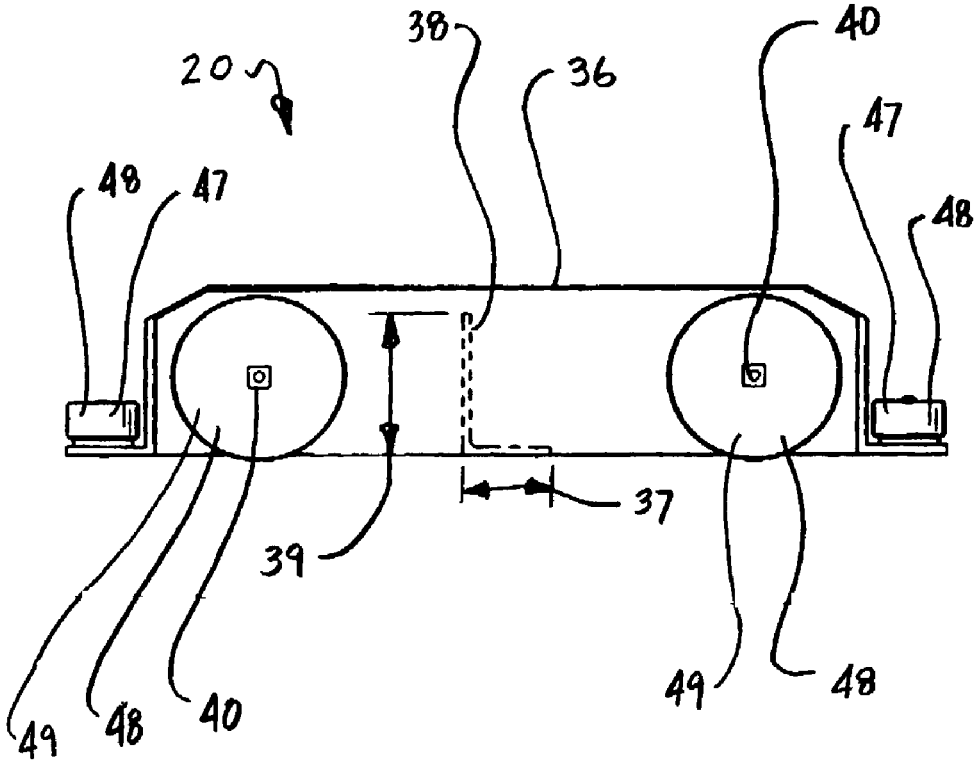
FIG. 6 shows a side elevation view of the second frame slidable support.

Next looking to FIG. 5 and FIG. 6 a portion of the crane hoist apparatus 20 is shown as a perspective view of the second frame slidable support 40 of the second frame 36 by the first frame 30 and a side elevation view of the second frame slidable support 40 on the first frame 30 respectively. The first frame 30 has a plurality of beams or running rails 32 that each include a lengthwise span, a width or horizontal extension 31, and a depth or vertical extension 33. The second frame 36 has a second frame beam 38 with a lengthwise span, a width or horizontal extension 37, and a depth or vertical extension 39. The second frame or bridge 36 is slidably supported 40 by the first frame 30 and in particular the first frame beams 32 in an approximately transverse span orientation. The positional of relationship between the first frame 30 and the second frame 36 is such that the second frame depth 39 does not extend below the first frame depth 33, this allows for the minimal loss of vertical headroom within the enclosure interior volume 28. In other words, the first frame 30 and the second frame 36 generally occupy the same vertical space envelope within the enclosure interior 24.

The dynamic relationship between the second frame 36 and the first frame 30 is such that the second frame 36 is able to move in a direction parallel to the first frame 30 span of the first frame beams 32. The slidable support 40 preferably comprises a second plurality of rollers 48 slidably supporting the second frame 36 on the first frame 30 or more particularly on the first frame beams 32. The second plurality of rollers 48 include a plurality of second large rollers 49 that have a rotational axis parallel to the first frame being width or horizontal extension 31 with the second large rollers 49 being in rolling engagement with the first frame horizontal extension 31. The second large rollers 49 are preferably constructed of a resilient material capable of the aforementioned crane hoist apparatus 20 loads, being about 6 inches in diameter and 2 inches wide, with other sizes acceptable that meet the minimizing of vertical headroom consumed by the crane hoist apparatus 20 and the aforementioned load requirements. Also included in the second plurality of rollers 48 is a plurality of the second small rollers 47 that have a rotational axis parallel to the first frame and beam depth or vertical extension 33 with the second small rollers 47 being in rolling engagement with the first frame vertical extension 33. The second small rollers 47 are preferably constructed of a resilient material capable of the aforementioned crane hoist apparatus 20 loads, being about 2½ inches in diameter and 1¼ inches wide, with other sizes acceptable that meet the minimizing of vertical headroom consumed by the crane hoist apparatus 20.

Figure 7:
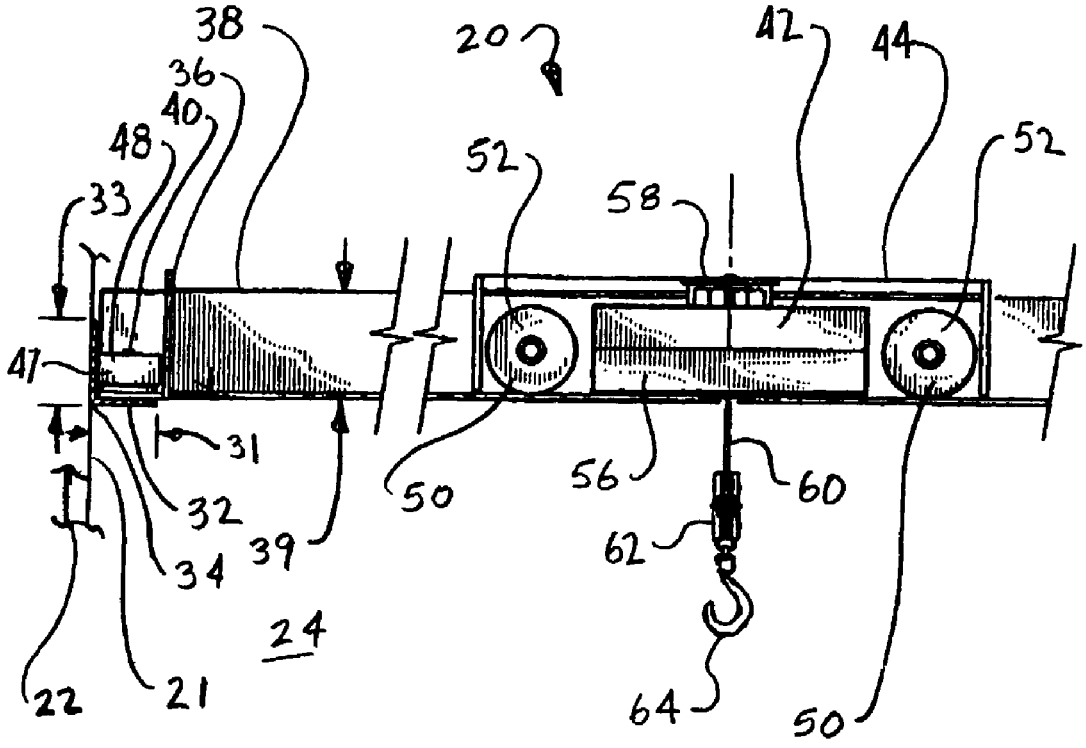
FIG. 7 shows a front elevation view of the winch carriage slidable support on the second frame and the second frame slidable support on the first frame.

Finally turning to FIG. 7 shown is a portion of the crane hoist apparatus 20 with the front elevation view of the winch carriage slidable support 44 on the second frame 36 and the second frame slidable support 40 on the first frame 30. The first frame beams or running rails 32 that each include a lengthwise span, a width or horizontal extension 31, and a depth or vertical extension 33 are supported by the interior sidewalls 21 of the enclosure 22. The second frame 36 has a second frame beam 38 with a lengthwise span, a width or horizontal extension 37 (not shown in this view), and a depth or vertical extension 39. The second frame or bridge 36 is slidably supported 40 by the first frame 30 and in particular the first frame beams 32 in an approximately transverse span orientation. The positional of relationship between the first frame 30 and the second frame 36 is such that the second frame depth 39 does not extend below the first frame depth 33, this allows for the minimal loss of vertical headroom within the enclosure interior volume 28. In other words, the first frame 30 and the second frame 36 generally occupy the same vertical space envelope within the enclosure interior 24.

The dynamic relationship between the second frame 36 and the first frame 30 is such that the second frame 36 is able to move in a direction parallel to the first frame 30 span of the first frame beams 32. The slidable support 40 preferably comprises a second plurality of rollers 48 slidably supporting the second frame 36 on the first frame 30 or more particularly on the first frame beams 32. The second plurality of rollers 48 include a plurality of second large rollers 49 that have a rotational axis parallel to the first frame being width or horizontal extension 31 with the second large rollers 49 being in rolling engagement with the first frame horizontal extension 31. Also included in the second plurality of rollers 48 is a plurality of the second small rollers 47 that have a rotational axis parallel to the first frame and beam depth or vertical extension 33 with the second small rollers 47 being in rolling engagement with the first frame vertical extension 33.

The winch carriage 42 includes a hoist 56, and a hoist or winch carriage cable 60, a pulley block 62 with a hook 64, with all of the aforementioned components being supported by a hoist support structure 58. The slidable support 44 of the winch carriage 42 is comprised of a third plurality of rollers 50 for supporting the winch carriage 44 by the second frame 36 being more particularly the second frame beam 38. The third plurality of rollers 50 preferably includes a plurality of third large rollers 52 having a rotational axis parallel to the second frame beam width or horizontal extension 37 with the third large rollers 52 being in rolling engagement with the second frame horizontal extension 37.

METHOD OF USE

Returning to FIG. 1 and FIG. 2 a method in given for moving an item 26 within, into, out of, and adjacent to a containerized cargo enclosure 22 by use of a crane hoist apparatus 20 that is adapted to be supported by the enclosure 22 that can move items from a first location to a selected location. A first step is to provide the crane hoist apparatus 20 that is adapted to be supported by the enclosure sidewalls 21 wherein the crane hoist apparatus 20 is a part of the enclosure 22. The next step is to move in combination, the winch carriage 42 that is slidably engaged on the second frame 36 of the crane hoist apparatus 20 and the second frame 36 that is slidably engaged on the first frame 30 of the crane hoist apparatus 20 to the first location, that is where the item or cargo 26 that is desired to be moved currently rests. A further step is to lower the winch carriage cable 60 with the pulley block 62 and hook 64 of the winch carriage 42 to a first selected elevation. Following this, the hook 64, with the pulley block 62, and winch carriage cable 60 is attached to the item 26. After the item 26 is attached to the hook 64, the item 26 is lifted utilizing the cable 60 of the hoist 56 to a second selected elevation, resulting in the item 26 being suspended above the support surface, being either the floor surface of the enclosure 27 or the adjacent surface 29 to the enclosure 22. A next step is to move in combination, the winch carriage 42 on the second frame 36 of the crane hoist apparatus 20 and the second frame 36 on the first frame 30 of the crane hoist apparatus 20 to the selected location, which would be either on the floor surface of the enclosure 27 or on the surface adjacent to the enclosure 29. Finally, utilizing the cable 60 of the hoist 56, item 26 is lowered to rest item 26 on either the floor surface of the enclosure 27 or on the surface adjacent to the enclosure 29.

In addition, further steps of extending the first frame 30 from a first retracted position, wherein the first frame 30 is completely accommodated within the enclosure 22 interior 24 to a second extended position as shown in FIGS. 1 and 2 resulting in the first frame 30 being on the exterior 25 of the enclosure 22. The purpose of this step is to accommodate moving the item 26 to or from the surface adjacent to the enclosure 29 into or out of the enclosure interior 24 from the floor surface of the enclosure 27. Additionally, the foregoing step can be reversed wherein the first frame 30 is moved from the second extended position to the first retracted position resulting in the ability to move the item 26 from the surface area adjacent to the enclosure 29 to the floor surface 27 inside of the enclosure 22.

CONCLUSION

Accordingly, the present invention of a crane hoist apparatus has been described with some degree of particularity directed to the embodiments of the present invention. It should be appreciated, though, that the present invention is defined by the following claims construed in light of the prior art so modifications the changes may be made to the exemplary embodiments of the present invention without departing from the inventive concepts contained therein.

The invention claimed is:

1. A crane hoist apparatus for use in moving items within, into, out of, and adjacent to an interior of a containerized cargo enclosure with a minimal loss of interior enclosure volume from the crane, comprising:

(a) a first frame having a plurality of beams that each include a lengthwise span, a width, and a depth, said first frame is supported by the containerized cargo enclosure;

(b) a second frame having a beam with a lengthwise span, a width, and a depth, said second frame is slidably supported by said first frame in an approximately transverse span orientation such that said second beam depth does not extend below said first frame depth, said second frame is able to move in a direction parallel to said first frame span; and (c) a winch carriage that is slidably supported by said second frame beam such that said winch carriage does not extend beyond said second frame beam depth, said winch carriage being able to move in a direction parallel to said second frame beam span, wherein said second frame beam is a single "L" beam and further including a cable attached to said winch carriage for lifting an item.

2. A crane hoist apparatus according to claim 1 wherein said first frame is attached to the interior of the containerized cargo container with a slidable support that allows said first frame to movably extend parallel to said first frame spans between a first retracted position in which said first frame is accommodated entirely with in the interior of the containerized cargo enclosure to a second extended position in which said first frame extends to an exterior of the containerized cargo enclosure from the interior of the containerized cargo enclosure.

3. A crane hoist apparatus according to claim 2 further including a first plurality of rollers for providing said slidable support of said first frame in the interior of the containerized cargo enclosure.

4. A crane hoist apparatus according to claim 1 wherein said second frame includes a plurality of rollers for slidably supporting said second frame by said first frame.

5. A crane hoist apparatus according to claim 4 wherein the plurality of rollers includes a plurality of second large rollers having a rotational axis parallel to said first frame beam width and a plurality of second small rollers having a rotational axis parallel to said first frame beam depth.

6. A crane hoist apparatus according to claim 1 wherein said winch carriage includes a plurality of rollers for said winch carriage to be slidably supported by said second frame.

7. A crane hoist apparatus according to claim 6 wherein said plurality of rollers includes a plurality of large rollers having a rotational axis parallel to said second frame beam width and a plurality of small rollers having a rotational axis parallel to said second frame beam depth.

8. A crane hoist apparatus for use in moving items within, into, out of, and adjacent to an interior of a containerized cargo enclosure with a minimal loss of interior enclosure volume from the crane, comprising:

(a) a first frame having a plurality of beams that are each constructed of a "L" beam that includes a horizontal extension, a vertical extension and a lengthwise span, said first frame is supported by the containerized cargo enclosure;

(b) a second frame having a beam that is constructed of a "L" beam that includes a horizontal extension, a vertical extension and a lengthwise span, said second frame is slidably supported by said first frame in an approximately transverse span orientation such that said second frame does not extend below said beam vertical extension of said first frame, said second frame is able to move in a direction parallel to said first frame span; and (c) a winch carriage that is slidably supported by said second frame "L" beam such that said winch carriage does not extend beyond said second frame "L" beam vertical extension, said winch carriage being able to move in a direction parallel to said second frame "L" beam span wherein said second frame "L" beam is a single beam and said winch carriage has a cable attached for lifting an item.

9. A crane hoist apparatus according to claim 8 wherein said first frame is attached to the interior of the containerized cargo container with a slidable support that allows said first frame to movably extend parallel to said first frame spans between a first retracted position in which said first frame is accommodated entirely within the interior of the containerized cargo enclosure to a second extended position in which said first frame extends to an exterior of the containerized cargo enclosure from the interior of the containerized cargo enclosure.

10. A crane hoist apparatus according to claim 9 further including a first plurality of rollers for supporting said first frame in the interior of the containerized cargo enclosure.

11. A crane hoist apparatus according to claim 8 wherein said second frame includes a plurality of rollers for said second frame to be slidably supported by said first frame.

12. A crane hoist apparatus according to claim 11 wherein said plurality of rollers includes a plurality of second large rollers that are in rolling engagement with said first frame horizontal extension and a plurality of small rollers that are in rolling engagement with said first frame vertical extension.

13. A crane hoist apparatus according to claim 8 wherein said winch carriage includes a plurality of rollers for said winch carriage to be slidably supported by said second frame.

14. A crane hoist apparatus according to claim 13 wherein said plurality of rollers for said winch carriage includes a plurality of large rollers that are in rolling engagement with said second frame horizontal extension and a plurality of small rollers that are in rolling engagement with said second frame vertical extension.

* * * * *